US008182400B1

(12) United States Patent
Martin

(10) Patent No.: US 8,182,400 B1
(45) Date of Patent: May 22, 2012

(54) JUMP ROPE EXERCISE SYSTEM

(76) Inventor: Marvin L. Martin, Tampa, FL (US)

( * ) Notice: Subject to any disclaimer, the term of this patent is extended or adjusted under 35 U.S.C. 154(b) by 0 days.

(21) Appl. No.: 13/066,860

(22) Filed: Apr. 27, 2011

(51) Int. Cl.
*A63B 5/22* (2006.01)

(52) U.S. Cl. ..... 482/81; 482/82

(58) Field of Classification Search ..... 482/81, 482/82; 473/424
See application file for complete search history.

(56) References Cited

U.S. PATENT DOCUMENTS

| | | | | | |
|---|---|---|---|---|---|
| 512,815 | A | * | 1/1894 | Denler | 482/81 |
| 1,826,944 | A | * | 10/1931 | McGavin | 482/81 |
| 2,181,979 | A | * | 12/1939 | Schaeffer | 482/81 |
| 2,944,817 | A | * | 7/1960 | Stiller | 473/424 |
| D250,609 | S | * | 12/1978 | Lang et al. | D21/672 |
| 5,211,612 | A | * | 5/1993 | Carbonero | 482/81 |
| 6,837,808 | B1 | * | 1/2005 | Hatch | 473/424 |

* cited by examiner

*Primary Examiner* — Glenn Richman

(57) ABSTRACT

A pole has upper and lower ends and upper, lower and intermediate regions. A rope has interior and exterior ends. The rope is fabricated of a flexible material. An interior connector couples the interior end of the rope to the lower region of the pole. A weight is provided. An exterior connector couples the exterior end of the rope to the interior extent of the weight.

1 Claim, 2 Drawing Sheets

JUMP ROPE EXERCISE SYSTEM

BACKGROUND OF THE INVENTION

Field of the Invention

The present invention relates to a jump rope exercise system and more particularly pertains to a sole teacher facilitating the exercising of a plurality of students in an entertaining atmosphere, the exercising being done in a safe, convenient and economical manner.

SUMMARY OF THE INVENTION

In view of the disadvantages inherent in the known types of exercise systems of known designs and configurations now present in the prior art, the present invention provides an improved jump rope exercise system. As such, the general purpose of the present invention, which will be described subsequently in greater detail, is to provide a new and improved jump rope exercise system and method which has all the advantages of the prior art and none of the disadvantages.

To attain this, the present invention essentially comprises a jump rope exercise system. First provided is a vertically oriented pole. The pole has a height of 48 inches, plus or minus 10 percent. The pole has an upper end. The upper end is provided above. The pole has a lower end. The lower end is provided below. The pole has an intermediate end. The intermediate end is provided between the upper and lower ends. The pole has a diameter of 1 inch, plus or minus 10 percent. The pole has a lower region. The lower region extends upwardly from the lower end for 16 inches, plus or minus 10 percent. The pole has an upper region. The upper region extends downwardly from the upper end for 16 inches, plus or minus 10 percent. The pole has an intermediate region. The intermediate region extends between the upper and lower regions for 16 inches, plus or minus 10 percent. The pole is rigid. The pole is fabricated of wood.

A horizontally oriented rope is provided. The rope has a diameter of 0.50 inches, plus or minus 50 percent. The rope has an interior end. The rope has an exterior end. The interior and exterior ends are separated by a length of 10 feet, plus or minus 20 percent. The rope is fabricated of a flexible, essentially inextensible material.

Provided next is an interior connector. The interior connector couples the interior end of the rope to the lower region of the pole. The interior connector is located 6 inches, plus or minus 33.3 percent, from the lower end of the pole. The interior connector has plural rings. The interior connector also has headed pins. In this manner free rotation about a horizontal axis is facilitated. Further in this manner entanglement of the rope during use is abated.

Further provided is a weight. The weight is in a tear shaped configuration. The weight has a hemispherically shaped exterior extent. The weight has a cone shaped interior extent. The weight is 1 pound, plus or minus 25 percent.

Provided last is an exterior connector. The interior connector couples the exterior end of the rope to the interior extent of the weight. The interior connector is located 6 inches, plus or minus 33.3 percent. The exterior connector has plural rings. The exterior connector also has headed pins. In this manner free rotation about a horizontal axis is facilitated. Further in this manner entanglement of the rope during use is abated.

The teacher is adapted to hold the intermediate region of the pole in a first hand of the user. The teacher is further adapted to hold the upper region of the pole in a second hand of the user. The teacher moves the pole in a circle at a sufficient speed. In this manner the speed of the movement provides an increased centrifugal force. Further in this manner the rope is kept moving in a horizontal plane 6 inches from the ground, plus or minus 50 percent.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jump rope exercise system which has all of the advantages of the prior art exercise systems of known designs and configurations and none of the disadvantages.

It is another object of the present invention to provide a new and improved jump rope exercise system which may be easily and efficiently manufactured and marketed.

It is further object of the present invention to provide a new and improved jump rope exercise system which is of durable and reliable constructions.

An even further object of the present invention is to provide a new and improved jump rope exercise system which is susceptible of a low cost of manufacture with regard to both materials and labor, and which accordingly is then susceptible of low prices of sale to the consuming public, thereby making such jump rope exercise system economically available to the buying public.

Even still another object of the present invention is to provide a jump rope exercise system for a sole teacher facilitating the exercising of a plurality of students in an entertaining atmosphere, the exercising being done in a safe, convenient and economical manner.

Lastly, it is an object of the present invention to provide a new and improved jump rope exercise system. A pole has upper and lower ends and upper, lower and intermediate regions. A rope has interior and exterior ends. The rope is fabricated of a flexible material. An interior connector couples the interior end of the rope to the lower region of the pole. A weight is provided. An exterior connector couples the exterior end of the rope to the interior extent of the weight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
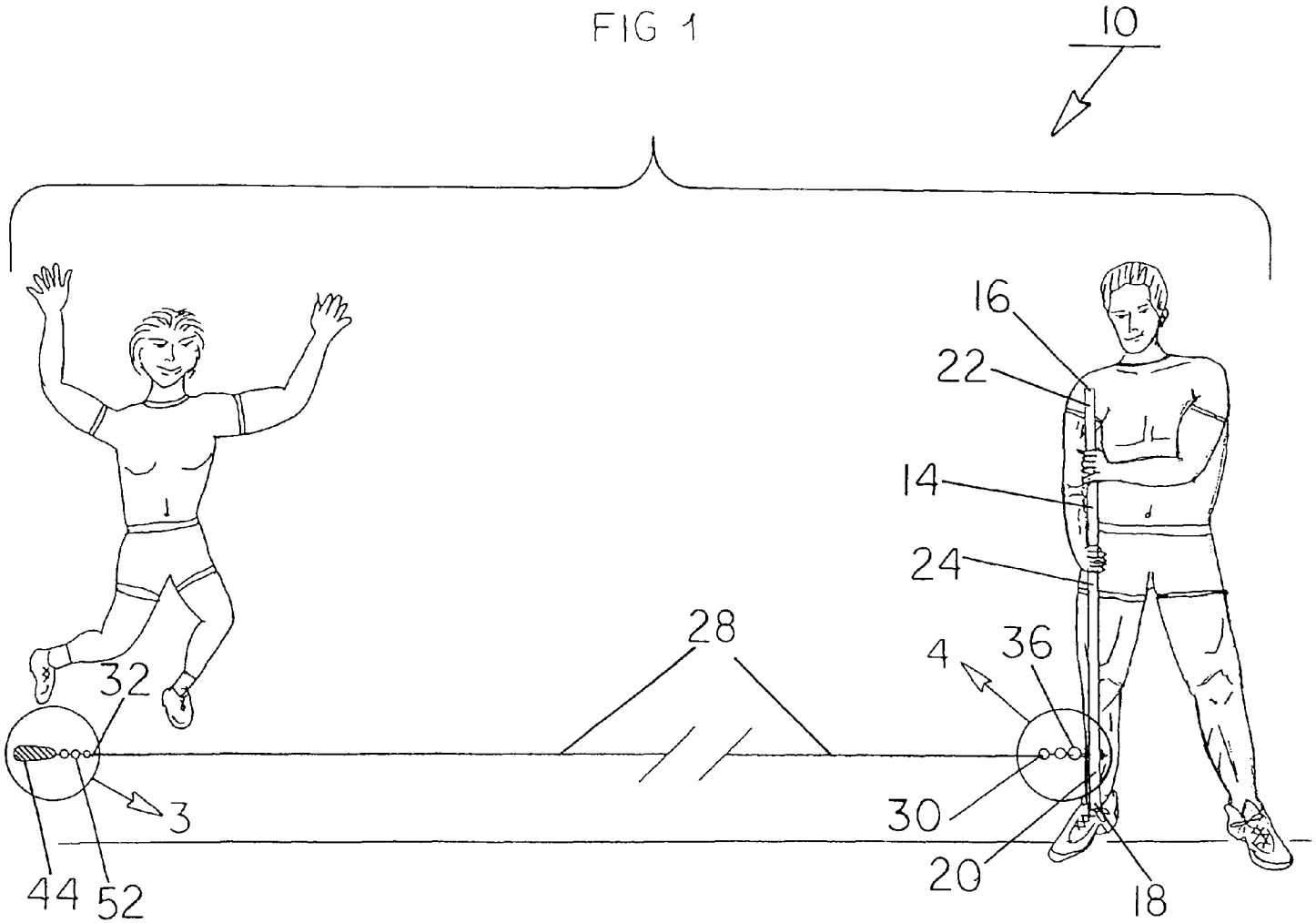
FIG. 1 is a front elevational view of a jump rope exercise system constructed in accordance with the principles of the present invention.
Figure 4:
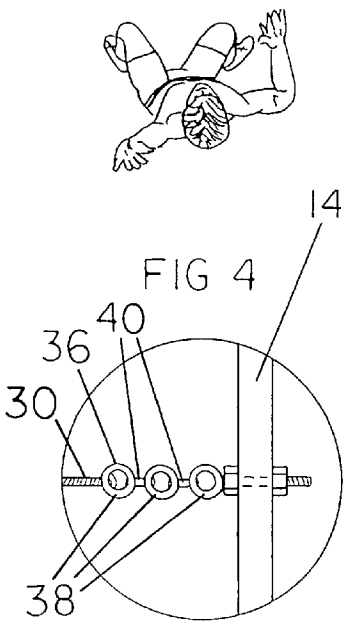
FIGS. 3 and 4 are enlarged showings of the ends of the rope illustrated in FIGS. 1 and 2.
Figure 2:
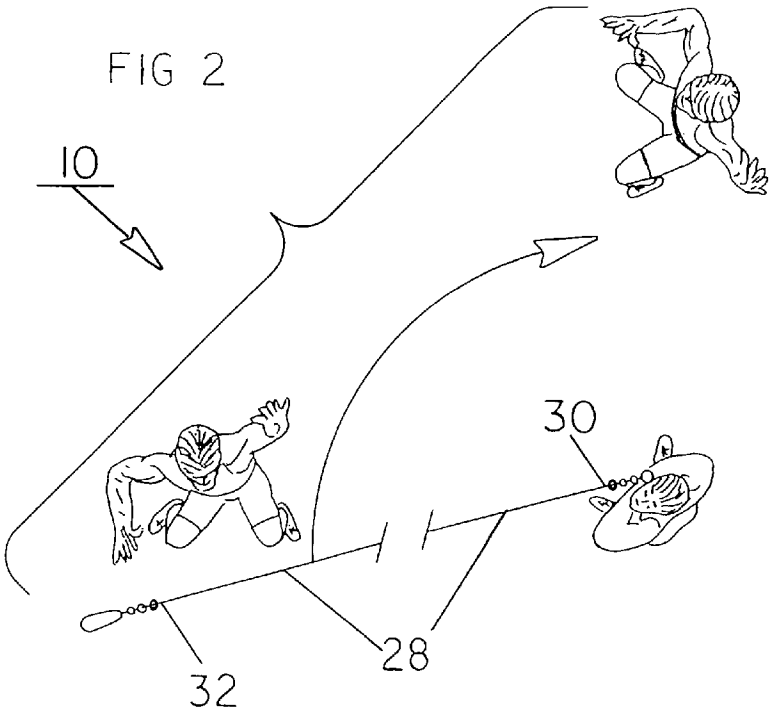
FIG. 2 is a plan view of the jump rope exercise system illustrated in FIG. 1.
Figure 3:
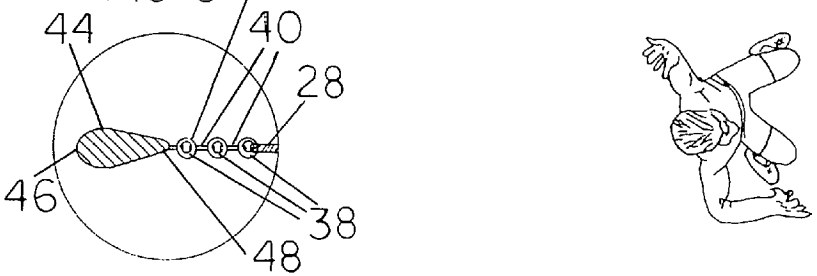

With reference now to the drawings, and in particular to FIG. 1 thereof, the preferred embodiment of the new and improved jump rope exercise system embodying the principles and concepts of the present invention and generally designated by the reference numeral 10 will be described.

The present invention, the jump rope exercise system 10 is comprised of a plurality of components. Such components in their broadest context include a pole, a rope, an interior connector, a weight and an exterior connector. Such components are individually configured and correlated with respect to each other so as to attain the desired objective.

First provided is a vertically oriented pole 14. The pole has a height of 48 inches, plus or minus 10 percent. The pole has an upper end 16. The upper end is provided above. The pole has a lower end 18. The lower end is provided below. The pole has an intermediate end. The intermediate end is provided between the upper and lower ends. The pole has a diameter of 1 inch, plus or minus 10 percent. The pole has a lower region 20. The lower region extends upwardly from the lower end for 16 inches, plus or minus 10 percent. The pole has an upper region 22. The upper region extends downwardly from the upper end for 16 inches, plus or minus 10 percent. The pole has an intermediate region 24. The intermediate region extends between the upper and lower regions for 16 inches, plus or minus 10 percent. The pole is rigid. The pole is fabricated of wood.

A horizontally oriented rope 28 is provided. The rope has a diameter of 0.50 inches, plus or minus 50 percent. The rope has an interior end 30. The rope has an exterior end 32. The interior and exterior ends are separated by a length of 10 feet, plus or minus 20 percent. The rope is fabricated of a flexible, essentially inextensible material.

Provided next is an interior connector 36. The interior connector couples the interior end of the rope to the lower region of the pole. The interior connector is located 6 inches, plus or minus 33.3 percent, from the lower end of the pole. The interior connector has plural rings 38. The interior connector also has headed pins 40. In this manner free rotation about a horizontal axis is facilitated. Further in this manner entanglement of the rope during use is abated.

Further provided is a weight 44. The weight is in a tear shaped configuration. The weight has a hemispherically shaped exterior extent 46. The weight has a cone shaped interior extent 48. The weight is 1 pound, plus or minus 25 percent.

Provided last is an exterior connector 52. The interior connector couples the exterior end of the rope to the interior extent of the weight. The interior connector is located 6 inches, plus or minus 33.3 percent. The exterior connector has plural rings 38. The exterior connector also has headed pins 40. In this manner free rotation about a horizontal axis is facilitated. Further in this manner entanglement of the rope during use is abated.

The teacher is adapted to hold the intermediate region of the pole in a first hand of the user. The teacher is further adapted to hold the upper region of the pole in a second hand of the user. The teacher moves the pole in a circle at a sufficient speed. In this manner the speed of the movement provides an increased centrifugal force. Further in this manner the rope is kept moving in a horizontal plane 6 inches from the ground, plus or minus 50 percent.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jump rope exercise system (10) wherein a sole teacher may facilitate the exercising of a plurality of students in an entertaining atmosphere, the exercising being done in a safe, convenient and economical manner, the system comprising, in combination:

a vertically oriented pole (14) having a height of 48 inches, plus or minus 10 percent, the pole having an upper end (16) above and a lower end (18) below and an intermediate end there between, the pole having a diameter of 1 inch, plus or minus 10 percent, the pole having a lower region (20) extending upwardly from the lower end for 16 inches, plus or minus 10 percent, the pole having an upper region (22) extending downwardly from the upper end for 16 inches, plus or minus 10 percent, the pole having an intermediate region (24) between the upper and lower regions for 16 inches, plus or minus 10 percent, the pole being rigid and fabricated of wood;

a horizontally oriented rope (28) having a diameter of 0.50 inches, plus or minus 50 percent, the rope having an interior end (30) and an exterior end (32) separated by a length of 10 feet, plus or minus 20 percent, the rope being fabricated of a flexible, essentially inextensible material;

an interior connector (36) coupling the interior end of the rope to the lower region of the pole, the interior connector located 6 inches, plus or minus 33.3 percent, from the lower end of the pole, the interior connector being formed of plural rings (38) and headed pins (40) to facilitate free rotation about a horizontal axis to abate entanglement of the rope during use;

a weight (44) in a tear shaped configuration, the weight having a hemispherically shaped exterior extent (46) and a cone shaped interior extent (48), the weight being 1 pound, plus or minus 25 percent;

an exterior connector (52) coupling the exterior end of the rope to the interior extent of the weight, the exterior connector located 6 inches, plus or minus 33.3 percent, the exterior connector being formed of plural rings (38) and headed pins (40) to facilitate free rotation about a horizontal axis to abate entanglement of the rope during use;

the intermediate region of the pole adapted to be held in a first hand of a teacher and the upper region of the pole adapted to be held in a second hand of the teacher while moving the pole in a circle at a sufficient speed whereby the speed of the movement will provide an increased centrifugal force to keep the rope moving in a horizontal plane 6 inches from the ground, plus or minus 50 percent.

* * * * *